US008337180B2

(12) United States Patent
Whaley et al.

(10) Patent No.: US 8,337,180 B2
(45) Date of Patent: Dec. 25, 2012

(54) MUD PUMP CYLINDER ASSEMBLY AND LINER SYSTEM

(75) Inventors: Jason Neal Whaley, Hartshorne, OK (US); Randall Weaver, McAlester, OK (US)

(73) Assignee: National Oilwell Varco, L.P., Houston, TX (US)

( * ) Notice: Subject to any disclaimer, the term of this patent is extended or adjusted under 35 U.S.C. 154(b) by 237 days.

(21) Appl. No.: 12/877,481

(22) Filed: Sep. 8, 2010

(65) Prior Publication Data

US 2011/0058959 A1 Mar. 10, 2011

Related U.S. Application Data

(60) Provisional application No. 61/240,812, filed on Sep. 9, 2009.

(51) Int. Cl.
*F04B 39/10* (2006.01)

(52) U.S. Cl. ..... 417/568; 92/170.1; 92/171.1

(58) Field of Classification Search ..... 417/568; 92/170.1, 171.1
See application file for complete search history.

(56) References Cited

U.S. PATENT DOCUMENTS

| | | | | |
|---|---|---|---|---|
| 3,902,404 | A * | 9/1975 | Breit | 92/86 |
| 5,899,136 | A | 5/1999 | Tarr et al. | |
| 2006/0123616 | A1 | 6/2006 | Aday et al. | |

FOREIGN PATENT DOCUMENTS

| | | | |
|---|---|---|---|
| GB | 2146096 | A | 4/1985 |

OTHER PUBLICATIONS

UK Combined Search and Examination Report, Dec. 20, 2010, Application No. GB1014902.9 (6 pp).

Canadian Office Action dated Mar. 5, 2012; Canadian Application No. 2,714,247 (2 p.).

* cited by examiner

*Primary Examiner* — Charles Freay
*Assistant Examiner* — Patrick Hamo
(74) *Attorney, Agent, or Firm* — Conley Rose, P.C.

(57) ABSTRACT

A fluid section for a reciprocating pump comprises a cylinder assembly including a housing having a central axis, a first end, a second end opposite the first end, and a throughbore extending axially between the first end and the second end. In addition, the cylinder assembly includes a liner disposed within the throughbore of the housing. Further, the cylinder assembly includes an end cap coupled to the second end of the housing. Still further, the cylinder assembly includes an annulus radially positioned between the liner and the housing, the annulus being in fluid communication with the throughbore of the liner. Moreover, the fluid section includes a piston slidingly disposed in the throughbore of the liner. The piston is adapted to compress a fluid disposed in a pumping chamber within the liner extending axially through the throughbore of the liner between the piston and the first end of the housing.

21 Claims, 11 Drawing Sheets

MUD PUMP CYLINDER ASSEMBLY AND LINER SYSTEM

CROSS-REFERENCE TO RELATED APPLICATIONS

This application claims benefit of U.S. provisional patent application Ser. No. 61/240,812 filed Sep. 9, 2009, and entitled "Cylinder Liner System," which is hereby incorporated herein by reference in its entirety.

STATEMENT REGARDING FEDERALLY SPONSORED RESEARCH OR DEVELOPMENT

Not applicable.

BACKGROUND

1. Field of Art

The invention relates generally to mud pumps, and more particularly, relates to a cylinder liner system for mud pumps. Still more particularly, the invention relates to a renewable, compressive stress loading system for the cylinder liner of a mud pump.

2. Description of the Related Art

In extracting hydrocarbons from the earth, it is common to drill a borehole into the earth formation containing the hydrocarbons. A drill bit is attached to a drill string, and during drilling operations, drilling fluid, or "mud" as it is also known, is pumped down through the drill string and into the hole through the drill bit. Drilling fluids are used to lubricate the drill bit and keep it cool. The drilling mud also cleans the bit, balances pressure, and carries sludge and formation cuttings created during the drilling process to the surface.

Pumps, typically referred to as slush or mud pumps, are commonly used for pumping the drilling mud. Such pumps used in these applications are typically reciprocating pumps of the duplex or triplex type. A duplex pump has two reciprocating pistons that each force drilling mud into a discharge line, while a triplex reciprocating pump has three pistons that force drilling mud into a discharge line. These reciprocating mud pumps can be single acting, in which drilling mud is discharged on alternate strokes, or double acting, in which each stroke discharges drilling mud.

The motion of the reciprocating pump piston subjects the cylinder liner to reciprocating axial shear forces and cyclical internal pressures. The axial shear forces can lead to tensile stresses in the liner, and the cyclical internal pressures can lead to hoop stresses, both of which contribute to undesirable metal fatigue. To counteract the effects of fatigue, radial compressive stress pre-loading is often applied to the cylinder liner such that the cyclical internal pressures and associated hoop stresses are balanced by the pre-load compressive forces on the liner.

Most conventional mud pump cylinder liner systems include a housing and a sleeve coaxially disposed within the housing via an interference fit. The sleeve forms the inside surface of the liner and is typically made of a very hard and brittle material, such as chrome iron or ceramic. The radial interference fit between the housing and the sleeve generates the radially compressive forces acting on the sleeve, which serve to counteract the cyclical internal pressures and associated stresses. This conventional approach to counteracting fatigue is referred to as "pre-loading" since the radially compressive stresses are applied to the sleeve prior to its employment in the reciprocating pump (i.e., before the piston is axially reciprocated within the sleeve).

The pistons and cylinders used for mud pumps are susceptible to a high degree of wear during use because the drilling mud is relatively dense and includes a relatively high proportion of suspended, abrasive solids. As the cylinder in which the piston reciprocates becomes worn, the small annular space between the piston head and the cylinder wall may increase substantially, often in an irregular fashion. The flow of fluid through the annular space between the piston head and cylinder wall decreases the efficiency of the pump. To aid in reducing the effect of this wear, the cylinder is typically provided with a limited life, expendable cylinder liner.

The abrasive nature of the drilling mud translates into a relatively short lifetime for the cylinder liner and necessitates frequent replacement of the cylinder liner. Changing a cylinder liner in a conventional mud pump is typically a difficult, dirty, and costly job. For example, many conventional liner systems require replacement of the entire cylinder assembly including the liner, the housing, etc., which can weigh in excess of one-hundred pounds. In addition, access to the many of the parts involved in the cylinder liner replacement is limited, placing the maintenance personnel in awkward positions, increasing the potential for back or other physical injuries. Moreover, since drilling operations cease during mud pump maintenance, and drilling rig time is very expensive, frequent replacement of cylinder liners may be both inconvenient and costly.

Accordingly, there remains a need for improved systems, apparatus, and methods for installing and compressively loading cylinder liners that address the foregoing difficulties. Such improved systems, apparatus, and methods would be particularly well-received if they offered the potential to reduce the likelihood of injury to service personnel, minimize rig downtime, and simplified cylinder liner replacement procedures.

BRIEF SUMMARY OF THE DISCLOSURE

These and other needs in the art are addressed in one embodiment by a fluid section for a reciprocating pump. In an embodiment, the fluid section comprises a cylinder assembly. The cylinder assembly includes a housing having a central axis, a first end, a second end opposite the first end, and a throughbore extending axially between the first end and the second end. In addition, the cylinder assembly includes a liner disposed within the throughbore of the housing, wherein the liner has a first end proximal the first end of the housing, a second end proximal the second end of the housing, and a throughbore extending between the first end and the second end of the liner. Further, the cylinder assembly includes an end cap coupled to the second end of the housing. The end cap is adapted to retain the liner within the housing. Still further, the cylinder assembly includes an annulus radially positioned between the liner and the housing. The annulus is in fluid communication with the throughbore of the liner. Moreover, the fluid section comprises a piston slidingly disposed in the throughbore of the liner. The piston is adapted to compress a fluid disposed in a pumping chamber within the liner, the pumping chamber extending axially through the throughbore of the liner between the piston and the first end of the housing.

These and other needs in the art are addressed in another embodiment by a reciprocating pump. In an embodiment, the reciprocating pump comprises a fluid section. The fluid section includes a housing having a central axis, a first end, a second end opposite the first end. In addition, the fluid section includes a liner coaxially disposed within the housing. The liner has a first end proximal the first end of the housing, a second end opposite the first end of the liner, and a cylindrical throughbore extending between the first end and the second end of the liner. Further, the fluid section includes an end cap removably coupled to the second end of the housing. The end cap axially abuts the second end of the liner. Still further, the fluid section includes an annulus radially positioned between the liner and the housing. The annulus is in fluid communication with the throughbore of the liner. Moreover, the fluid section includes a piston slidingly disposed in the throughbore of the liner. The reciprocating pump also comprises a power section connected to the piston with an extension rod. The power section is adapted to axially reciprocate the piston within the liner.

These and other needs in the art are addressed in another embodiment by a method for loading a liner of a fluid section of a reciprocating pump. In an embodiment, the method comprises disposing a cylindrical liner within a housing. The liner has a central axis, a first end, a second end opposite the first end, and a throughbore extending axially from the first end to the second end. In addition, the method comprises moving a piston axially through the throughbore of the liner. Further, the method comprises compressing a fluid in the throughbore with the piston. Still further, the method comprises flowing a portion of the fluid from the throughbore to an annulus radially positioned between the liner and the housing while moving the piston axially through the throughbore of the liner. Moreover, the method comprises applying radially compressive forces on the liner with the fluid in the annulus while compressing a fluid in the throughbore with the piston.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
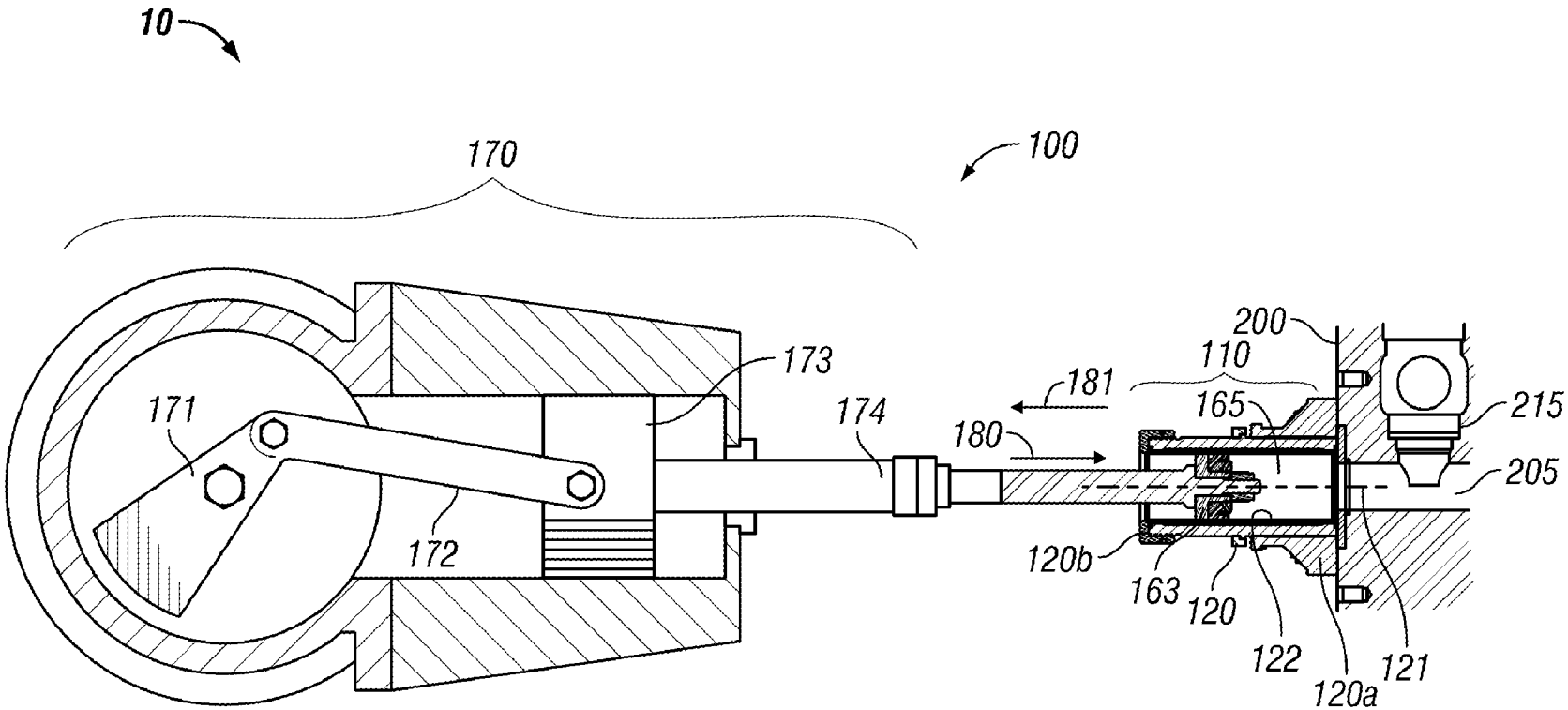
FIG. 1 is a cross-sectional view of an embodiment of a reciprocating pump including a cylinder liner assembly in accordance with the principles described herein.

The following discussion is directed to various embodiments of the invention. Although one or more of these embodiments may be presently preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a bore), while the terms "radial" and "radially" generally mean perpendicular to a central axis. For instance, an axial distance refers to a distance measured along or parallel to the central axis, and a radial distance means a distance measured perpendicular to the central axis.

Figure 2:
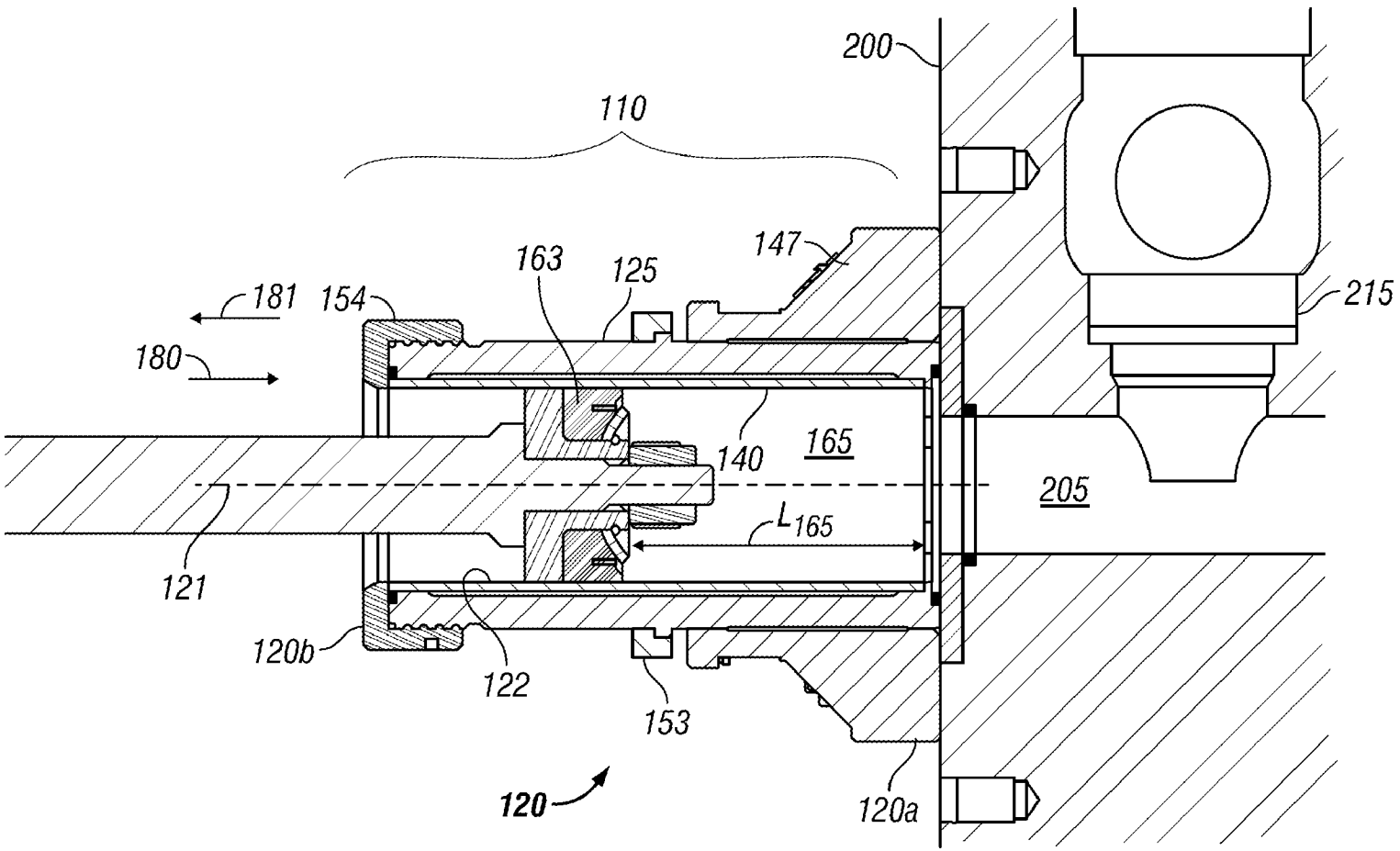
FIG. 2 is an enlarged partial cross-sectional view of the reciprocating pump of FIG. 1.

Referring now to FIGS. 1 and 2, an embodiment of a reciprocating pump 10 for pumping a fluid (e.g., drilling mud) is shown. Reciprocating pump 10 includes a piston-cylinder assembly 100 and a mud pump module 200 coupled to the piston-cylinder assembly 100. Mud pump module 200 comprises a flow passage or conduit 205, a suction or inlet valve (not shown) that regulates the flow of fluid into conduit 205, and a discharge or outlet valve 215 that regulates the flow of fluid out of conduit 205. The inlet valve and outlet valve 215 are each check valves configured to allow flow therethrough in only one direction. In particular, the inlet valve only allows fluid to flow from a fluid supply into conduit 205, and discharge valve 215 only fluid to flow out of conduit 205. The inlet valve restricts and/or prevents fluid flow from exiting conduit 205, and discharge valve 215 restricts and/or prevents fluid flow entering conduit 205.

Piston-cylinder assembly 100 includes a fluid section 110 attached to module 200 and a power section 170 distal module 200. As best shown in FIG. 2, fluid section 110 includes a cylinder assembly 120 and a piston 163. Cylinder assembly 120 has a central axis 121 and includes a first end 120*a* proximal module 200, a second end 120*b* opposite first end 120*b* and distal module 200, and an inner through bore 122 extending between ends 120*a, b*. Piston 163 is coaxially disposed within bore 122 and slidingly engages the radially inner surface of cylinder assembly 120. Piston 163 and cylinder assembly 120 define a chamber 165 within bore 122 axially disposed between piston 163 and first end 120*a*. Chamber 165 is in fluid communication with conduit 205 of module 200.

Referring again to FIG. 1, power section 170 includes a crankshaft 171, a connecting rod 172, and a crosshead 173. An extension rod 174 couples crosshead 173 to piston 163. During operation, a motor (not shown) powers the rotation of crankshaft 171, which in turn drives the reciprocation of piston 163 within cylinder assembly 120. In particular, the rotational motion of crankshaft 171 is translated into the reciprocating axial displacement of piston 163 relative to cylinder assembly 120. As piston 163 moves axially within bore 122 in a first direction 180, the volume within chamber 165 decreases, thereby compressing the fluid within chamber 165 and conduit 205. However, as piston 163 moves axially within bore 122 in a second direction 181 (that is opposite first direction 180), the volume within chamber 165 increases, thereby lowering the pressure of the fluid within chamber 165 and conduit 205. During operation, reciprocating pump 10 expels fluid from conduit 205 through the module outlet valve as piston 163 moves axially within bore 122 in the first direction 180, and draws fluid into conduit 205 through the intake valve of module into conduit 205 as piston 163 moves axially within bore 122 in the second direction 181.

In general, piston 163 may comprise any suitable piston, and preferably comprises a piston designed for use in mud pumps. Examples of suitable pistons are shown and described in PCT Patent Application Publication Nos. WO 2008/131430 and WO 2008/131429, each of which is incorporated herein by reference in its entirety for all purposes.

Referring now to FIGS. 3-6, as previously described, cylinder assembly 120 has a central axis 121, ends 120*a, b*, and a through bore 122 extending between ends 120*a, b*. In addition, cylinder assembly 120 includes a radially outer housing 125, a radially inner sleeve or liner 140 disposed within housing 125, an annular bushing 147 that secures cylinder assembly 120 to mud pump module 200, and an end cap or sleeve retainer 154 that retains liner 140 within housing 125. As will be described in more detail below, housing 125, liner 140, bushing 147, and sleeve retainer 154 are coaxially aligned, and thus, each has a central axis coincident with cylinder assembly central axis 121.

Figure 3:
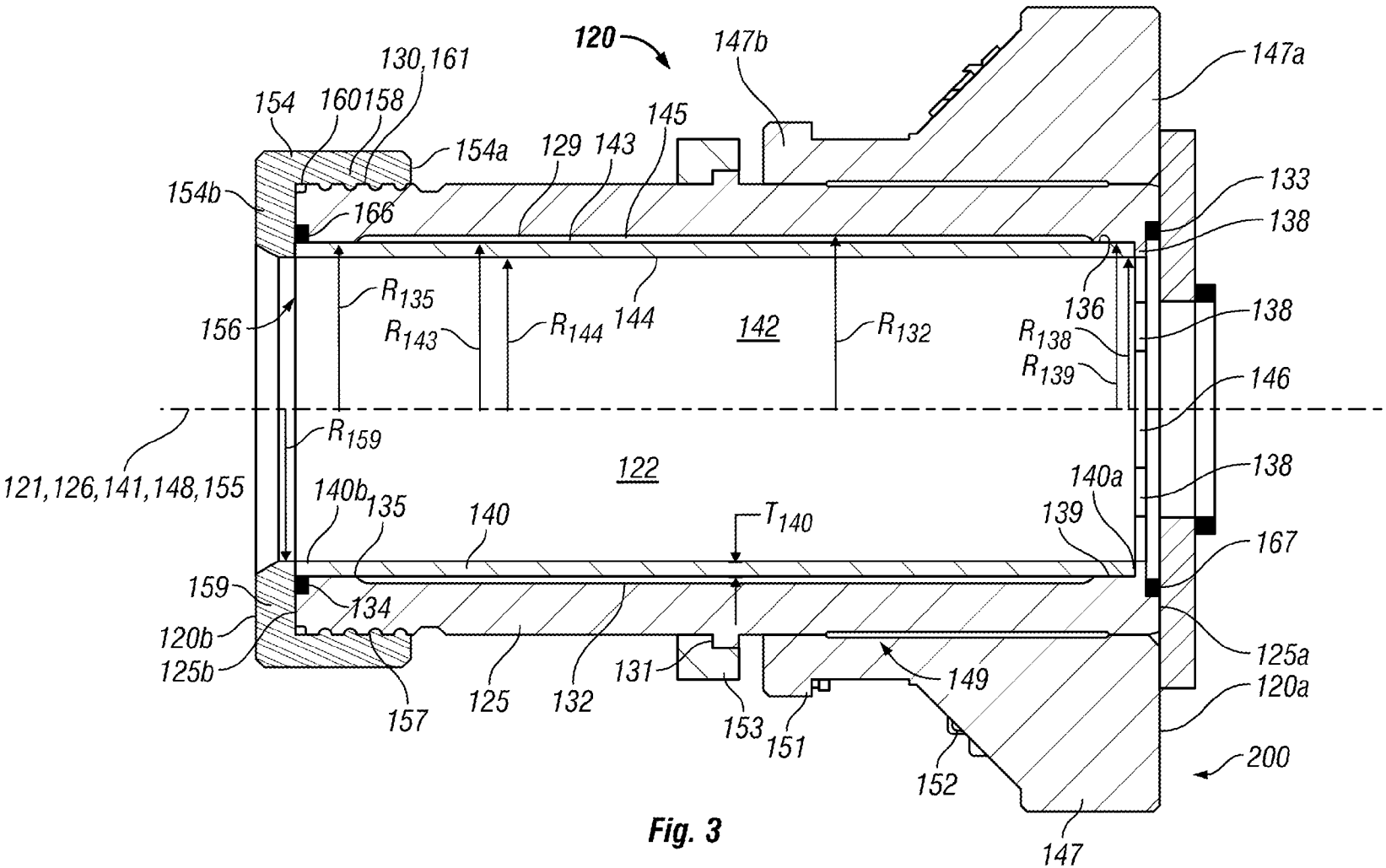
FIG. 3 is a cross-sectional view of the cylinder assembly of FIGS. 1 and 2.
Figure 4:
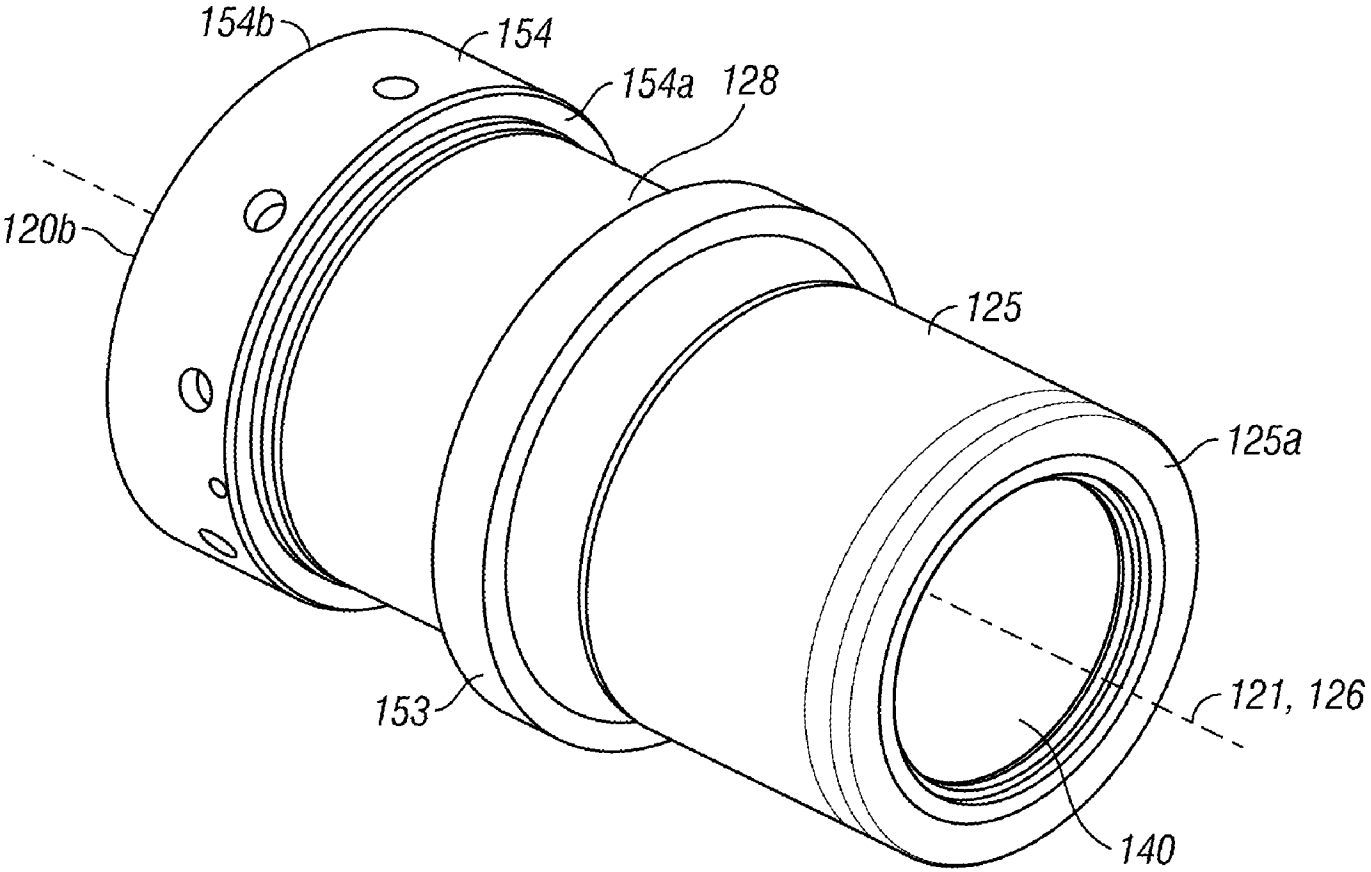
FIG. 4 is a perspective view of the cylinder assembly of FIGS. 1 and 2.
Figure 5:
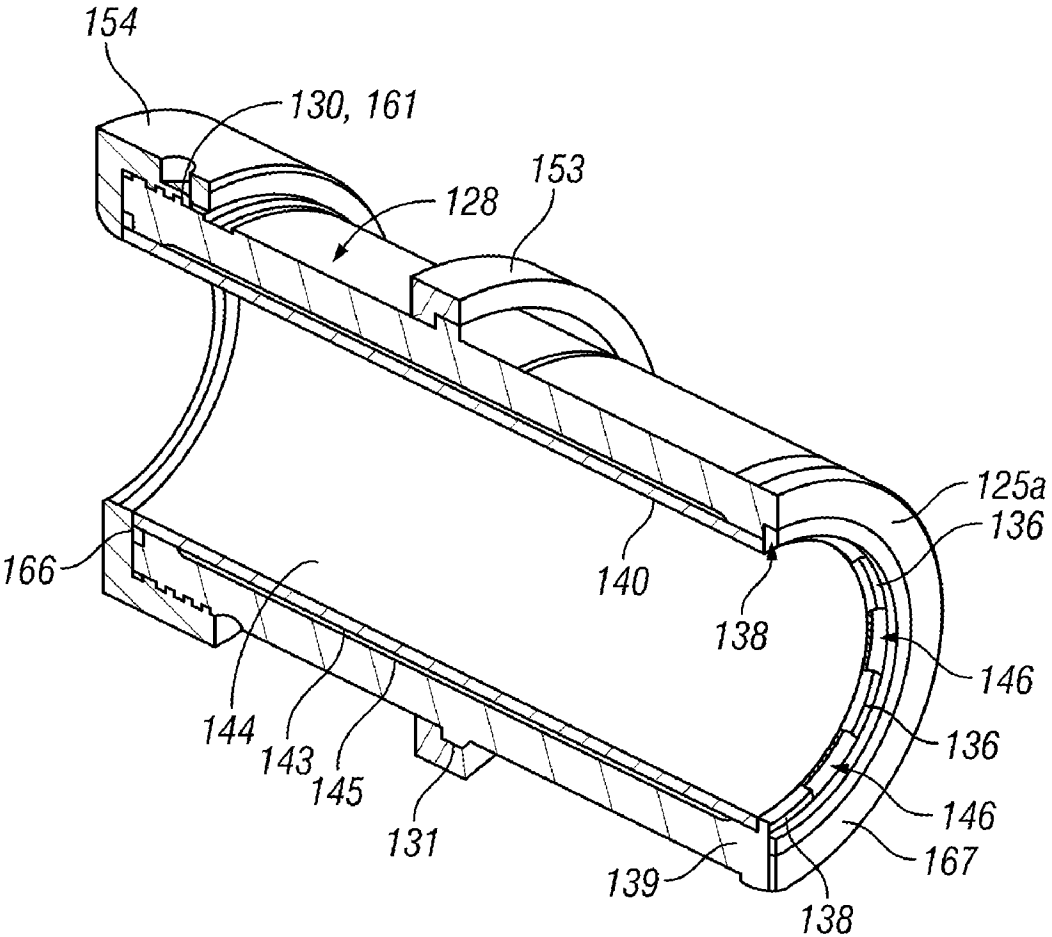
FIG. 5 is a perspective cross-sectional view of the cylinder assembly of FIGS. 1 and 2.
Figure 7:
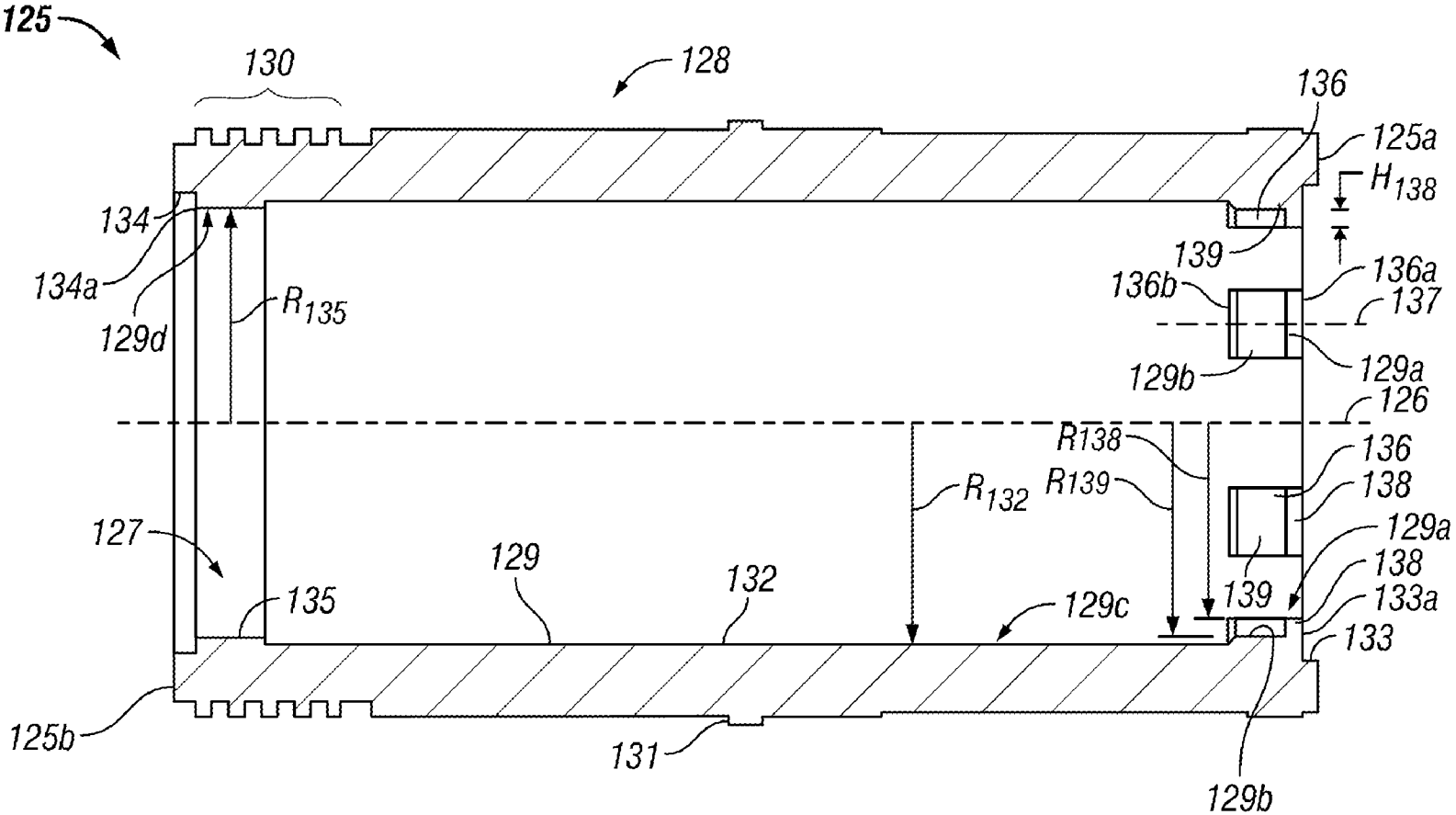
FIG. 7 is a cross-sectional view of the housing of FIG. 3.

Referring now to FIGS. 3 and 7, housing 125 is generally cylindrical, and has a central axis 126, a first or module end 125*a* that axially abuts module 200, a second or access end 125*b* distal module 200, and a central throughbore 127 extending axially between ends 125*a, b*. As best shown in FIGS. 3-5, upon assembly of cylinder assembly 120, central axis 126 is coincident with assembly axis 121, end 125*a* is coincident with assembly end 120*a*, and end 125*b* is proximal assembly end 120*b*.

Referring now to FIGS. 3, 4, 5, and 7, housing 125 has a radially outer surface 128 and a radially inner surface 129 defining throughbore 127. Outer surface 128 comprises external threads 130 proximal access end 125*b* and an annular shoulder 131 axially positioned between ends 125*a, b*. As best shown in FIGS. 3-5, an annular collar 153 is disposed about housing 125, axially abuts shoulder 131, and extends radially outward from housing 125. As will be described in more detail below, threads 130 engage mating internal threads on sleeve retainer 154, and collar 153 is used to couple housing 125 to bushing 147.

Referring still to FIGS. 3-5 and 7, housing inner surface 129 includes an annular band or ridge 135 proximal end 125*b*, a plurality of circumferentially-spaced lugs 136 proximal end 125*a*, and an annular recess 132 extending axially between ridge 135 and lugs 136. In this embodiment, six lugs 136 are provided, and further, lugs 136 are uniformly angularly and circumferentially spaced about inner surface 129. In particular, lugs 136 are angularly spaced about 60° apart about axis 126. Each lug 136 extends axially along a median line 137 between a first end 136*a* proximal end 125*a* and a second end 136*b* adjacent recess 132.

As best shown in FIG. 7, in this embodiment, each lug 136 is configured substantially the same. In particular, each lug 136 has a generally L-shaped cross-section including a radially extending flange 138 at first end 136*a*, and a base 139 extending axially between end 136*b* and flange 138. Each flange 138 extends radially inward relative to its corresponding base 139.

Referring still to FIG. 7, moving from lugs 136 to ridge 135, housing inner surface 129 may be described as including radially inner surfaces 129*a* along flange 138 of each lug 136, radially inner surfaces 129*b* along base 139 of each lug 136, a radially inner surface 129*c* along recess 132, and a radially inner surface 129*d* along ridge 135. Each surface 129*a* is disposed at a radius $R_{138}$, each surface 129*b* is disposed at a radius $R_{139}$ that is less than $R_{138}$, surface 129*c* is disposed at a radius $R_{132}$ that is less than $R_{138}$, and surface 129*d* is disposed at a radius $R_{135}$ that is the same as radius $R_{139}$. In this embodiment, inner surface 129 is disposed at radius $R_{132}$ between each pair of circumferentially adjacent lugs 136.

Referring again to FIGS. 3-5 and 7, throughbore 127 includes a counterbore 133 extending axially from end 125*a* to lugs 136, and a counterbore 134 extending axially from end 125*b* to ridge 135. A plurality of circumferentially spaced shoulders 133*a* are formed at the intersection of counterbore 133 and flanges 138, and an annular shoulder 134*a* is formed at the intersection of counterbore 134 and ridge 135.

Figure 6:
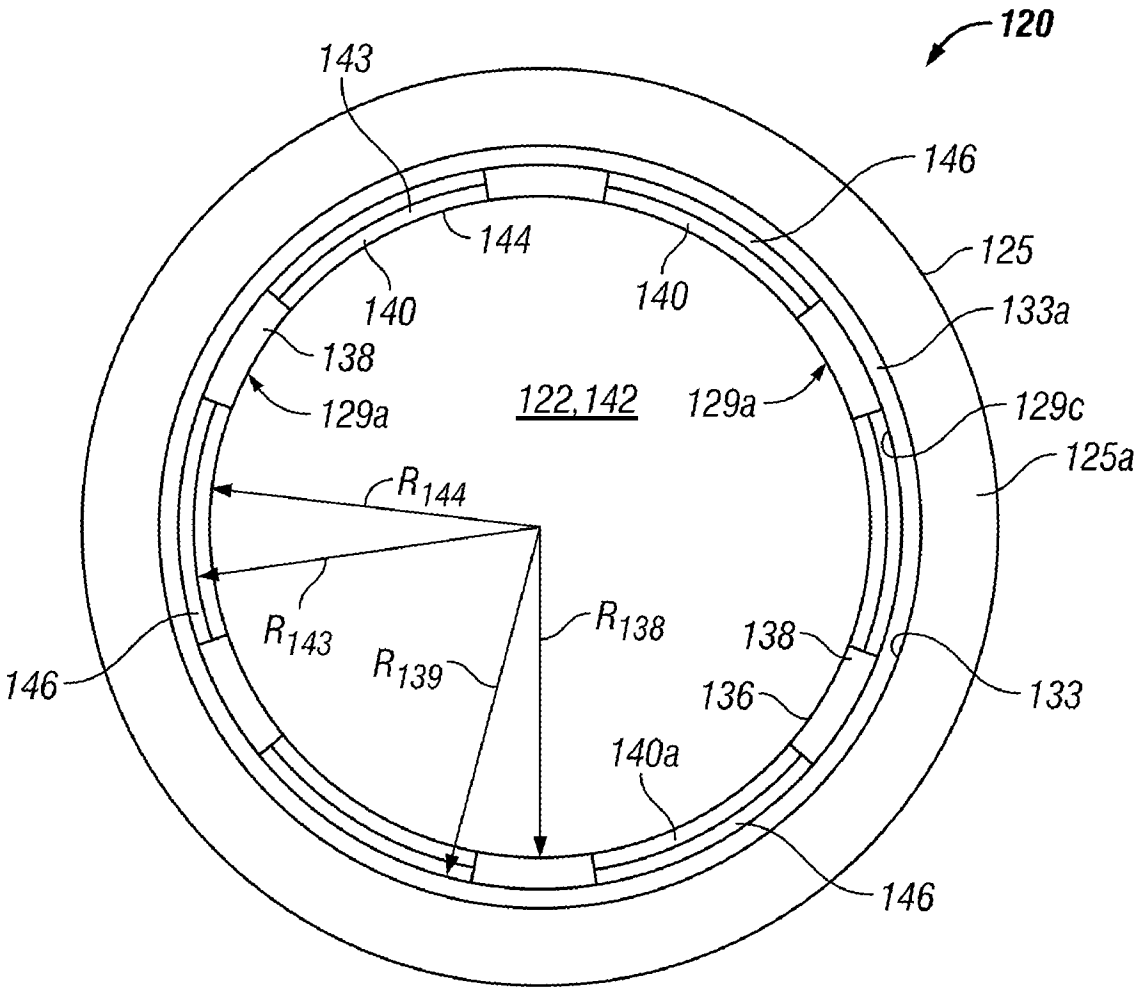
FIG. 6 is an end view of the cylinder assembly of FIGS. 1 and 2.

Referring now to FIGS. 3, 5, and 6, sleeve or liner 140 is a generally thin-walled cylindrical tubular having a central axis 141, a first end 140*a*, a second end 140*b* opposite first end 140*a*, and a central throughbore 142 extending axially between ends 140*a, b*. Together, throughbore 142 of liner 140, radially inner surfaces 129*a* of lug flanges 138, and counterbore 133 define throughbore 122 of cylinder assembly 120. As best shown in FIGS. 3-5, upon installation of liner 140 into housing 125, central axis 141 is coincident with assembly axis 121, end 140*a* axially abuts each flange 138, and end 140*b* axially abuts retainer 154. Thus, liner 140 has a length measured axially between ends 140*a, b* that is the same as the axial distance between lug flanges 138 and end 125*b*.

Liner 140 has a radially outer cylindrical surface 143 disposed at a radius $R_{143}$, and a radially inner cylindrical surface 144 disposed at a radius $R_{144}$. As best shown in FIG. 3, inner radius $R_{144}$ of liner 140 is the same as radius $R_{138}$ of each lug flange 138 such that liner inner surface 144 smoothly transition into radially inner surface 129*a* of each flange 138. Outer radius $R_{143}$ of liner 140 is substantially the same or slightly less than radius $R_{135}$ and radius $R_{139}$ of ridge 135 and flange bases 139, respectively. Consequently, outer surface 143 of liner 140 slidingly engages annular ridge 135 and each lug base 139. However, outer radius $R_{143}$ of liner 140 is less than radius $R_{132}$ of recess 132, resulting in the formation of an annulus 145 radially disposed between liner 140 and recess 132 of housing 125 and extending axially between ridge 135 and lugs 136.

Referring briefly to FIG. 2, and as will be described in more detail below, during pumping operations, fluid within annulus 145 exerts radially compressive forces on liner 140 to counteract the pressure (and associated hoop stresses) exerted on liner 140 by compressed fluid within chamber 165. To balance the increased pressure (and associated hoop stresses) in chamber 165 with the compressive forces in annulus 145, annulus 145 preferably extends axially from lugs 136 to at least piston 163 when the length $L_{165}$ of chamber 165 is a maximum (i.e., piston 163 is at its further axial position to the left in FIG. 2 and is transitioning from movement in the second direction 181 to movement in the first direction 180). As piston 163 moves in the first direction 180 and the volume of chamber 165 decreases, fluid in chamber 165 is compressed, thereby generating hoop stresses in liner 140. Thus, by configuring annulus 145 to extend axially from lugs 136 to at least piston 163 when the volume of chamber 165 is a maximum (i.e., the length $L_{165}$ of chamber 165 is a maximum), the compressive forces generated in annulus 145 are allowed to act on liner 140 along the entire length $L_{165}$ of chamber 165 as fluid in chamber 165 is compressed. In this embodiment, annulus 145 extends substantially the entire length of throughbore 142, and thus, has a length greater than the maximum length $L_{165}$ of chamber 165.

Referring again to FIGS. 3, 5, and 6, as previously described, outer radius $R_{143}$ of liner 140 is substantially the same or slightly less than radius $R_{135}$ of ridge 135 and radius $R_{139}$ of each lug base 139, and inner radius $R_{144}$ of liner 140 is the same as radius $R_{138}$ of each lug flange 138. Thus, the radial thickness $T_{140}$ of liner 140 (FIG. 3) measured radially between surfaces 143, 144 is substantially the same as the height $H_{138}$ of each flange 138 (FIG. 7) measured radially from inner surface 129*b* of each base 139 to inner surface 129*a* of each flange 138.

As best shown in FIG. 6, since the portions of inner surface 129 positioned between each pair of circumferentially adjacent lugs 136 are disposed at radius $R_{132}$, gaps or flow passages 146 in fluid communication with annulus 145 are formed between each pair of circumferentially adjacent lugs 136. Flow passages 146 are also in fluid communication with throughbores 122, 142 via counterbore 133 at end 125*a*. Thus, annulus 145 is in fluid communication with throughbores 122, 142 via flow passages 146.

In this embodiment, liner ends 140*a, b* are identical, liner outer radius $R_{143}$ is uniform between ends 140*a, b*, and liner inner radius $R_{144}$ is uniform between ends 140*a, b*. Thus, liner 140 is simply a cylindrical sleeve without any extraneous parts or structures. Such a simple design offers the potential for a lower cost, and easier to manufacture, liner.

Referring now to FIGS. 2 and 3, annular bushing 147 has a central axis 148, a first end 147*a* that axially abuts pump module 200, a second end 147*b* distal pump module 200, and a central throughbore 149 extending axially between ends 147*a, b*. End 147*b* includes an annular flange 151 that extends radially outward. In this embodiment, a clamp (not shown) is disposed about collar 153 and flange 151, extends between collar 153 and flange 151, and restricts collar 153 from moving axially relative to flange 151, thereby securing housing 125 to bushing 147. The clamp retains housing 125 in throughbore 149 and urges housing 125 into engagement with pump module 200 upon assembly. In general, any suitable clamp may be used to couple housing 125 and bushing 147. Examples of suitable clamps are disclosed in U.S. Pat. No. 7,287,460, which is hereby incorporated herein by reference for all purposes. Further, although the clamp is employed in this embodiment to couple housing 125 and bushing 147, in general, any suitable means may be employed to couple the housing (e.g., housing 125) and the collar (e.g., bushing 147) together including, without limitation, mating threads, bolts, or combinations thereof.

Upon assembly of fluid section 110, bushing central axis 148 is coincident with assembly axis 121, and end 147*a* is coincident with end 120*a*. Bushing 147 secures cylinder assembly 120 to pump module 200, such as via bolts or studs 152. Although bushing 147 is coupled to pump module 200 with studs 152 in this embodiment, in general, any suitable means may be employed to connect bushing 147 to pump module 200.

Referring now to FIGS. 2-5, annular sleeve retainer 154 has a central axis 155, a first end 154*a*, a second end 154*b*, and a central throughbore 156 extending axially between ends 154*a, b*. Throughbore 156 includes a counterbore 157 extending axially from end 154*a*. Consequently, as best shown in FIG. 3, retainer 154 has a generally L-shaped cross-section including an axially extending base 158 and a radially extending flange 159. In particular, base 158 extends axially from end 154*a* to flange 159, and flange 159 extends radially inward from base 158 at end 154*b*. Flange 159 extends radially inward to a radius $R_{159}$ that is less than outer radius $R_{143}$ of liner 140 and substantially the same or slightly greater than inner radius $R_{144}$ of liner 140. Thus, upon assembly of cylinder assembly 120, flange 159 of retainer 154 extends radially inward beyond liner outer surface 143. Retainer 154 has a radially inner surface 160 that extends between ends 154*a, b*. Along base 158 (i.e., within counterbore 157), inner surface 160 includes internal threads 161 that engage mating external threads 130 of housing 125.

The various components of cylinder assembly 120 (e.g., housing 125, liner 140, retainer 154, and bushing 147) may comprise any suitable materials including, without limitation, metals (e.g., aluminum), metal alloys (e.g., steel), non-metals (e.g., composites, ceramics), or combinations thereof. However, housing 125, liner 140, retainer 154, and bushing 147 each preferably comprise a relatively durable, rigid material capable of withstanding cyclical stresses and the harsh pumping conditions (e.g., abrasive fluids, high pressures, dirty environment, etc.) such as metals or metal alloys.

Referring now to FIGS. 2 and 3, to assembly cylinder assembly 120, liner 140 is coaxially aligned with housing 125, and axially inserted and advanced into housing throughbore 127 at housing end 125*b*. As previously described, liner outer radius $R_{143}$ is substantially the same or slightly less than ridge inner radius $R_{135}$ and lug inner radii $R_{138}$. Consequently, during axial insertion of liner 140 into throughbore 127, liner outer surface 143 slidingly engages radially inner surfaces 129*d*, 129*b* of ridge 135 and lug bases 138, respectively, however, outer surface 143 of liner 140 does not engage inner surfaces 129*a* or 129*c*. Liner 140 is axially advanced through housing throughbore 127 until end 140*a* axially abuts lug flanges 138. As previously described, the axial length of liner 140 measured between ends 140*a, b* is substantially the same as the axial length between end 125*b* and lug flanges 138, and thus, when end 140*a* abuts lug flanges 138, liner end 140*b* is flush with housing end 125*b*.

With liner 140 sufficiently disposed within housing 125, an annular seal member 166 is disposed about liner end 140*b* within housing counterbore 134. In other words, seal member 166 is radially positioned between liner 140 and housing shoulder 134*a* at end 125*b*. Seal member 166 restricts and/or prevents the axial flow of fluids between liner 140 and housing 125 at ends 125*b*, 140*b*. In this embodiment, seal member 166 has a generally rectangular cross-section. However, in general, the seal member (e.g., seal member 166) may have any suitable geometry including, without limitation, circular, oval, etc. Seal member 166 preferably comprises a resilient elastomeric and/or composite sealing material.

Referring still to FIG. 2, once seal member 166 is seated in counterbore 134 about liner 140, retainer 154 is coupled to end 125*b* of housing 125. In particular, retainer 154 is coaxially aligned with housing 125 and threaded onto housing 125 via mating threads 130, 161. Retainer 154 is threaded onto end 125*b* of housing 125 until retainer flange 159 axially abuts housing end 125*b*, liner end 140*b*, and seal member 166. As retainer 154 is torqued down into engagement with ends 125*b*, 140*b*, seal member 166 is axially compressed between retainer flange 159 and shoulder 134*a*. As seal member 166 is axially squeezed, it expands radially into enhanced sealing engagement with housing 125 and liner 140. It should be appreciated that once retainer 154 is secured to housing 125, retainer flange 159 engages liner end 140*b*, and liner end 140*a* axially abuts lug flanges 138. Thus, the axial position of liner 140 relative to housing 125 is maintained by lug flanges 138 and retainer flange 159.

Referring still to FIGS. 2 and 3, cylinder assembly 120 is coupled to module 200 via bushing 147 and studs 152. An annular seal member 167 is seated in housing counterbore 133 at end 125*a*, and cylinder assembly 120 is axially inserted into and advanced through bushing throughbore 149 until housing end 125*a* is proximal module 200. As previously described, a clamp is disposed about housing 125 and end 147*b* of bushing 147, engages collar 153 and flange 151, and axially urges housing 125 into engagement with pump module 200. As housing end 125*a* axially abuts module 200, seal member 167 is axially compressed between module 200 and housing shoulder 134*a*. Seal member 167 restricts and/or prevents the radial flow of fluids between housing end 125*a* and module 200. As seal member 167 is axially squeezed, its sealing engagement with housing 125 and module 200 is enhanced. Similar to seal member 166 previously described, in this embodiment, seal member 167 has a generally rectangular cross-section. However, in general, the seal member (e.g., seal member 167) may have any suitable geometry including, without limitation, circular, oval, etc. Seal member 167 preferably comprises a resilient elastomeric and/or composite sealing material.

In general, bushing 147 may be secured to module 200 before or after housing 125 is coupled to bushing 147. Further, housing 125 may be coupled to bushing 147 before or after liner 140 is disposed within housing 125 and retainer 154 is threaded onto housing 125. Obviously, liner 140 is disposed in housing 125 prior to threading retainer 154 onto housing 125, seal member 166 is disposed about liner 140 within recess 134 prior to threading retainer 154 onto housing 125, and seal member 167 is positioned within recess 133 before housing end 125*a* engages module 200.

In the manner described, cylinder assembly 120 is assembled and coupled to module 200. As best shown in FIGS. 1 and 2, once cylinder assembly 120 is secured to module 200, piston 163 is coaxially disposed within liner 140, thereby defining chamber 165. During operation of pump 10, piston 164 is axially actuated by power section 170—piston reciprocates back-and-forth within liner 140 in first direction 180, then second direction 181, then first direction 180, and so on. As piston 164 moves in the first direction 180, fluid in chamber 165 is pressurized, thereby subjecting liner 140 to internal pressure and associated hoop stresses. However, annulus 145 radially positioned between liner 140 and housing 125 is in fluid communication with chamber 165 via flow passages 146. Thus, the pressure in annulus 125 is substantially the same as the pressure in chamber 165. As the pressure in chamber 165 increases, the pressure in annulus 125 also increases, thereby exerting radially compressive forces on liner 140 that serve to counteract the radially expansive forces exerted on liner 140 by the pressure within chamber 165. Without being limited by this or any particular theory, exertion of compressive forces on the liner (e.g., liner 140) offer the potential to prolonging the lifetime of the liner.

Referring now to FIGS. 2 and 3, liner 140 may be repaired, replaced, and/or serviced during operations by shutting down power section 170, bleeding pressure from conduit 205, chamber 165, and annulus 145, and then removing retainer 154 from housing 125. Retainer 154 may be removed by rotating retainer 154 relative to housing 125 about axes 126, 155 to unscrew retainer 154 from housing 125 and decouple threads 130, 161. Once retainer 154 is removed, seal member 166 is removed from housing recess 134, and liner 140 may be accessed and axially pulled from housing 125. Once liner 140 is repaired and/or replaced, the repaired or new liner 140 is axially inserted into housing bore 127 until end 140*a* abuts lug flanges 138, and then, seal member 166 is disposed about liner end 140*b* in recess 134 and retainer 154 is screwed back onto housing 125 until flange 159 axially abuts seal liner end 140*b* and housing end 125*b*, thereby axially compressing seal member 166. In the manner described, liner 140 may be accessed for repair, service, or replacement with relative ease. Compared to some conventional cylinder assemblies that require the removal of the entire assembly to access and repair the cylinder liner, embodiments described herein (e.g., cylinder assembly 120) offer the potential for relatively simple access to the liner (e.g., liner 140) by removal of the retainer (e.g., retainer 154) coupled to the end of the housing (e.g., housing 125).

Figure 8:
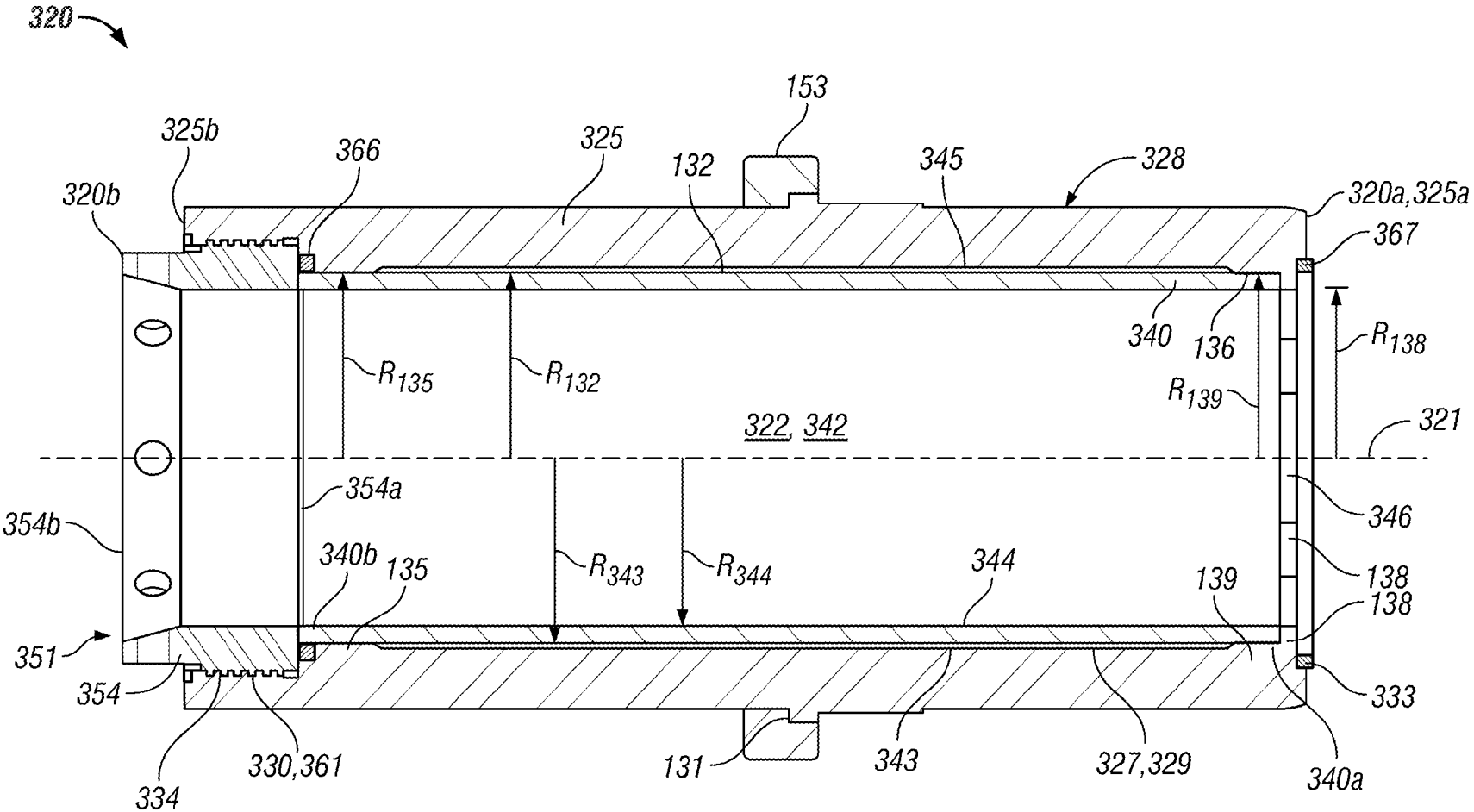
FIG. 8 is a cross-sectional view of an embodiment of a cylinder assembly in accordance with the principles described herein.

Referring now to FIG. 8, an alternative embodiment of a cylinder assembly 320 for use with a reciprocating pump (e.g., pump 10) is shown. For example, assembly 320 may be used in place of cylinder assembly 120 previously described. Assembly 320 is substantially the same in structure and function as cylinder assembly 120. Namely, cylinder assembly 320 has a central axis 321, ends 320*a, b*, and a through bore 322 extending between ends 320*a, b*. In addition, cylinder assembly 320 includes a radially outer housing 325, a cylindrical liner 340 coaxially disposed within housing 325, and an end cap or sleeve retainer 354 that retains liner 340 within housing 325. Housing 325, liner 340, and sleeve retainer 354 are coaxially aligned, and thus, each has a central axis coincident with cylinder assembly central axis 321.

Housing 325 is generally cylindrical, and has a first or module end 325*a*, a second or access end 325*b* opposite end 325*a*, and a central throughbore 327 extending axially between ends 325*a, b*. In addition, housing 325 has a radially outer surface 328 and a radially inner surface 329 defining throughbore 327. Similar to outer surface 128 previously described, in this embodiment, outer surface 328 comprises an annular shoulder 131 as previously described axially positioned between ends 325*a, b*. An annular collar 153 as previously described is disposed about housing 325, axially abuts shoulder 131, and extends radially outward from housing 325. Collar 153 is used to couple housing 325 to a bushing secured to the pump module (e.g., bushing 147) with a clamp. However, unlike housing 125 previously described, in this embodiment, housing outer surface 328 does not include external threads at end 325*b*.

Referring still to FIG. 8, inner surface 329 includes an annular band or ridge 135 as previously described proximal end 325*b*, a plurality of circumferentially-spaced lugs 136 as previously described proximal end 325*a*, and an annular recess 132 as previously described extending axially between ridge 135 and lugs 136. However, unlike housing 125 previously described, in this embodiment, inner surface 329 includes internal threads 330 within a counterbore 334 extending from end 325*b*. As will be described in more detail below, internal threads 330 mate and engage with external threads provided on retainer 354. An annular seal member 366 is axially disposed between retainer 354 and ridge 135, and an annular seal member 367 is axially disposed within a counterbore 333 at housing end 325*a* between housing 325 and the mud module (not shown).

Liner 340 is substantially the same as liner 140 previously described. Namely, liner 340 is a generally thin-walled cylindrical tubular having a first end 340*a* that axially abuts lug flanges 138, a second end 140*b* that axially abuts retainer 354, and a central throughbore 342 extending axially between ends 340*a, b*.

Liner 340 has a radially outer cylindrical surface 343 disposed at a radius $R_{343}$, and a radially inner cylindrical surface 344 disposed at a radius $R_{344}$. Inner radius $R_{344}$ of liner 340 is the same as radius $R_{138}$ of each lug flange 138. Outer radius $R_{343}$ of liner 340 is substantially the same or slightly less than radius $R_{135}$ and radius $R_{139}$ of ridge 135 and flange bases 139, respectively. Consequently, outer surface 343 of liner 340 slidingly engages annular ridge 135 and each lug base 139. However, outer radius $R_{343}$ of liner 340 is less than radius $R_{132}$ of recess 132, resulting in the formation of an annulus 345 radially disposed between liner 340 and recess 132 of housing 325 and extending axially between ridge 135 and lugs 136. Annulus 345 preferably has an axial length equal to or greater than the maximum axial length of the compression chamber (e.g., chamber 165) formed in cylinder assembly 320 between end 320*a* and a piston (e.g., piston 163) disposed within throughbore 342.

The portions of inner surface 329 positioned between each pair of circumferentially adjacent lugs 136 are disposed at radius $R_{132}$, and thus, gaps or flow passages 346 in fluid communication with annulus 345 are formed between each pair of circumferentially adjacent lugs 336. Flow passages 146 are also in fluid communication with throughbores 322, 342 via counterbore 333 at end 325*a*. Thus, annulus 345 is in fluid communication with throughbores 322, 342 via flow passages 346.

Referring still to FIG. 8, annular sleeve retainer 354 has a first end 354*a*, a second end 354*b*, and a central throughbore 356 extending axially between ends 354*a, b*. In addition, retainer 354 has a radially outer surface 360 that includes external threads 361 that engage mating internal threads 330 of housing 325. Upon assembly of cylinder assembly 320, end 354*a* axially abuts liner end 340*b* and axially compresses seal member 366.

Figure 9:
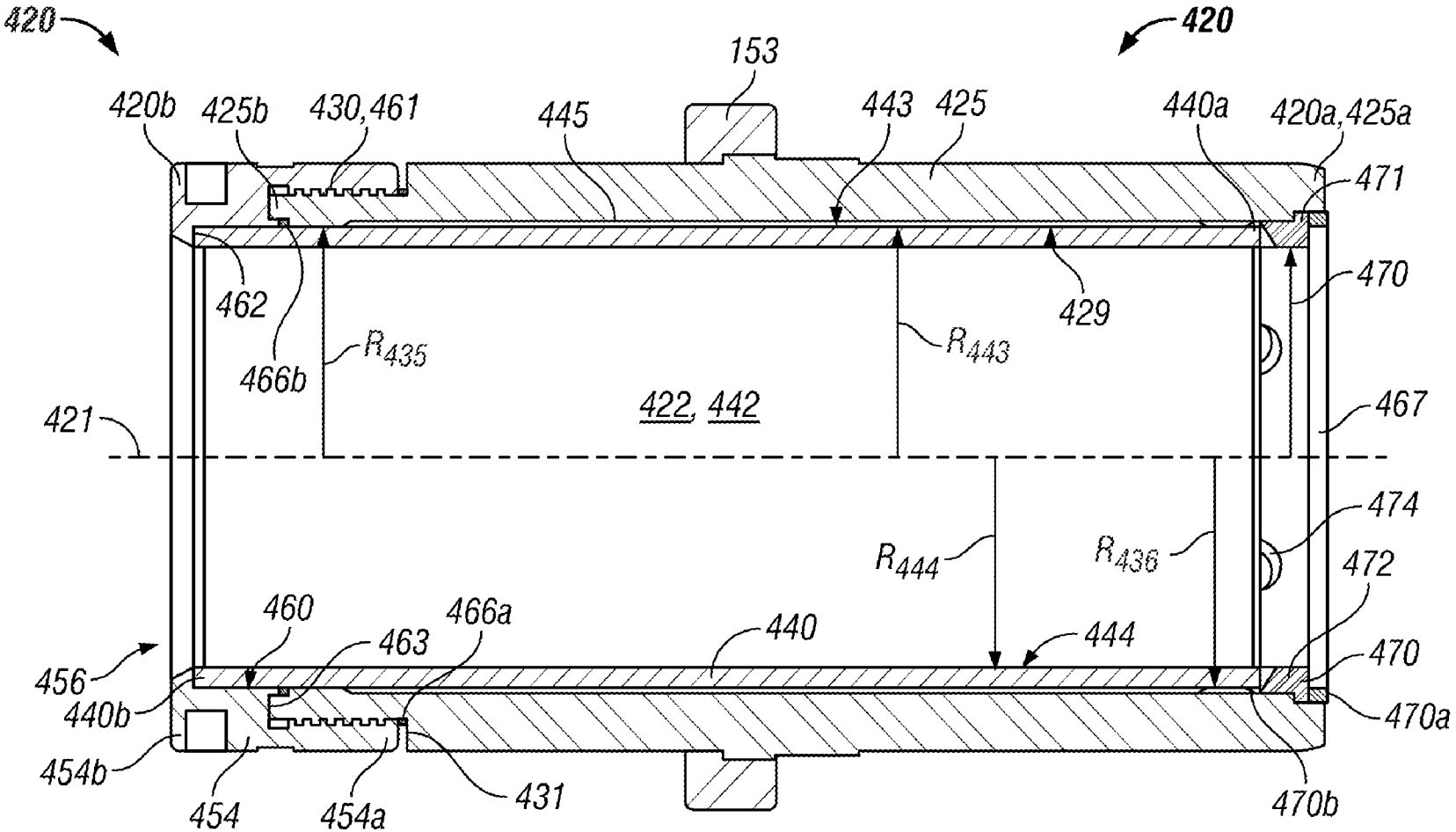
FIG. 9 is a cross-sectional view of an embodiment of a cylinder assembly in accordance with the principles described herein.

Referring now to FIG. 9, an alternative embodiment of a cylinder assembly 420 for use with a reciprocating pump (e.g., pump 10) is shown. For example, assembly 420 may be used in place of cylinder assembly 120 previously described. Assembly 420 is substantially the same in structure and function as cylinder assembly 120. Namely, cylinder assembly 420 has a central axis 421, ends 420*a, b*, and a throughbore 422 extending between ends 420*a, b*. In addition, cylinder assembly 420 includes a radially outer housing 425, a cylindrical liner 440 coaxially disposed within housing 425, and an end cap or sleeve retainer 454 that retains liner 440 within housing 425. However, unlike cylinder assembly 120, in this embodiment, cylinder assembly 420 also includes an annular pressure balance insert 470 disposed in housing 425 and axially positioned between end 425*a* and liner 440. Housing 425, liner 440, sleeve retainer 454, and insert 470 are coaxially aligned, and thus, each has a central axis coincident with cylinder assembly central axis 421.

Figure 10:
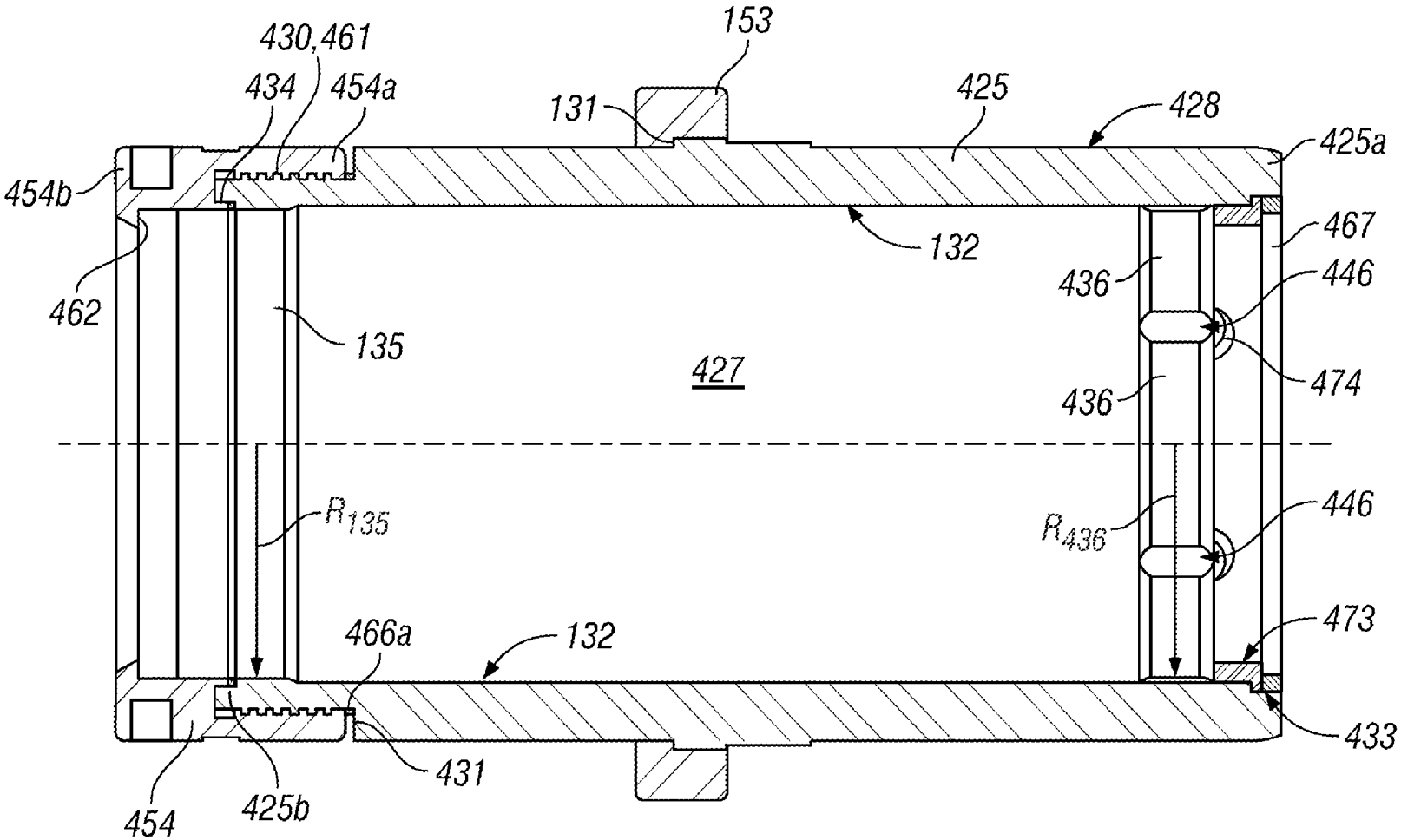
FIG. 10 is a cross-sectional view of the housing of FIG. 9.

Referring now to FIGS. 9 and 10, housing 425 is generally cylindrical, and has a first or module end 425*a*, a second or access end 425*b* opposite end 425*a*, and a central throughbore 427 extending axially between ends 425*a, b*. Throughbore 427 includes a counterbore 433 extending axially from end 425*a*, and a counterbore 434 extending axially from end 425*b*. In addition, housing 425 has a radially outer surface 428 and a radially inner surface 429 defining throughbore 427. Similar to outer surface 128 previously described, in this embodiment, outer surface 428 comprises an annular shoulder 131 as previously described axially positioned between ends 425*a, b*. An annular collar 153 as previously described is disposed about housing 425, axially abuts shoulder 131, and extends radially outward from housing 425. Collar 153 is used to couple housing 425 to a bushing secured to the pump module (e.g., bushing 147) with a clamp. In addition, in this embodiment, housing outer surface 428 includes external threads 430 at end 425*b* and an annular shoulder 431 axially adjacent threads 430. As will be described in more detail below, external threads 430 mate and engage with internal threads 461 provided in retainer 454.

As best shown in FIG. 10, inner surface 429 includes an annular band or ridge 135 as previously described proximal end 425*b*, a plurality of circumferentially-spaced lugs 436 proximal end 425*a*, and an annular recess 132 as previously described extending axially between ridge 135 and lugs 436. Unlike lugs 136 previously described, in this embodiment, lugs 436 do not include a radially extending flange (e.g., flange 138). Each lug 436 has a radially inner surface disposed at a radius $R_{436}$.

Referring again to FIG. 9, liner 440 is similar to liner 140 previously described. Namely, liner 440 is a generally thin-walled cylindrical tubular having a first end 440*a*, a second end 440*b*, and a central throughbore 442 extending axially between ends 440*a, b*. End 440*a* axially abuts insert 470 and end 440*b* axially abuts retainer 454. Further, liner 440 has a radially outer cylindrical surface 443 disposed at a radius $R_{443}$, and a radially inner cylindrical surface 444 disposed at a radius $R_{444}$. Inner radius $R_{444}$ of liner 440 is the same as the inner radius $R_{470}$ of insert 470. Outer radius $R_{443}$ of liner 440 is substantially the same or slightly less than radius $R_{135}$ and radius $R_{436}$ of ridge 135 and flanges 436, respectively. Consequently, outer surface 443 of liner 440 slidingly engages annular ridge 135 and each lug 436. However, outer radius $R_{443}$ of liner 440 is less than radius $R_{132}$ of recess 132, resulting in the formation of an annulus 445 radially disposed between liner 440 and recess 132 of housing 425 and extending axially between ridge 135 and lugs 436. As best shown in FIG. 10, the portions of inner surface 429 positioned between each pair of circumferentially adjacent lugs 436 are disposed at radius $R_{132}$, and thus, gaps or flow passages 446 in fluid communication with annulus 445 are formed between each pair of circumferentially adjacent lugs 436. Annulus 445 preferably has an axial length equal to or greater than the maximum axial length of the compression chamber (e.g., chamber 165) formed in cylinder assembly 420 between end 420*a* and a piston (e.g., piston 163) disposed within throughbore 442.

Pressure balance insert 470 has a first end 470*a* distal liner 440 and a second end 470*b* that engages liner end 440*a*. In addition, insert 470 has a generally L-shaped cross-section including a flange 471 at end 470*a* and a base 472 extending axially from end 470*b* to flange 471. Flange 471 extends radially outward from base 472 into counterbore 433, and base 472 engages inner surface 429 of housing 425 proximal counterbore 433.

Insert 470 also includes a plurality of circumferentially spaced cutouts 474 along end 470*b*. Cutouts 474 extend radially through insert 470 from insert inner surface 473 to the flow passages 446 between circumferential adjacent lugs 436. Thus, annulus 445 is in fluid communication with throughbores 422, 442 via cutouts 474 and the flow passages between circumferentially adjacent lugs 436. In this embodiment, one cutout 474 is provided for each flow passage 446, and further, each cutout 474 is circumferentially aligned with one flow passage 446.

Referring still to FIGS. 9 and 10, annular sleeve retainer 454 has a first end 454*a*, a second end 454*b*, and a central throughbore 456 extending axially between ends 454*a, b*. In addition, retainer 454 has a stepped inner surface 460 including internal threads 461 proximal end 454*a*, a first annular shoulder 462 proximal end 454*b*, and a second inner shoulder 463 axially positioned between threads 461 and shoulder 462. Threads 461 engage mating housing threads 430, shoulder 463 axially abuts housing end 425*b*, and shoulder 462 axially abuts liner end 440*b*.

An annular seal member 467 is disposed within counterbore 433 axially adjacent insert 470. When coupled to the mud module (not shown), seal member 467 is axially compressed between insert 470 and the mud module. Further, in this embodiment, two annular seal members 466*a, b* are disposed axially between retainer 454 and housing 425—seal member 466*a* is axially disposed between retainer 454 and housing shoulder 431, and seal member 466*b* is axially disposed between ridge 135 and retainer 454.

Figure 11:
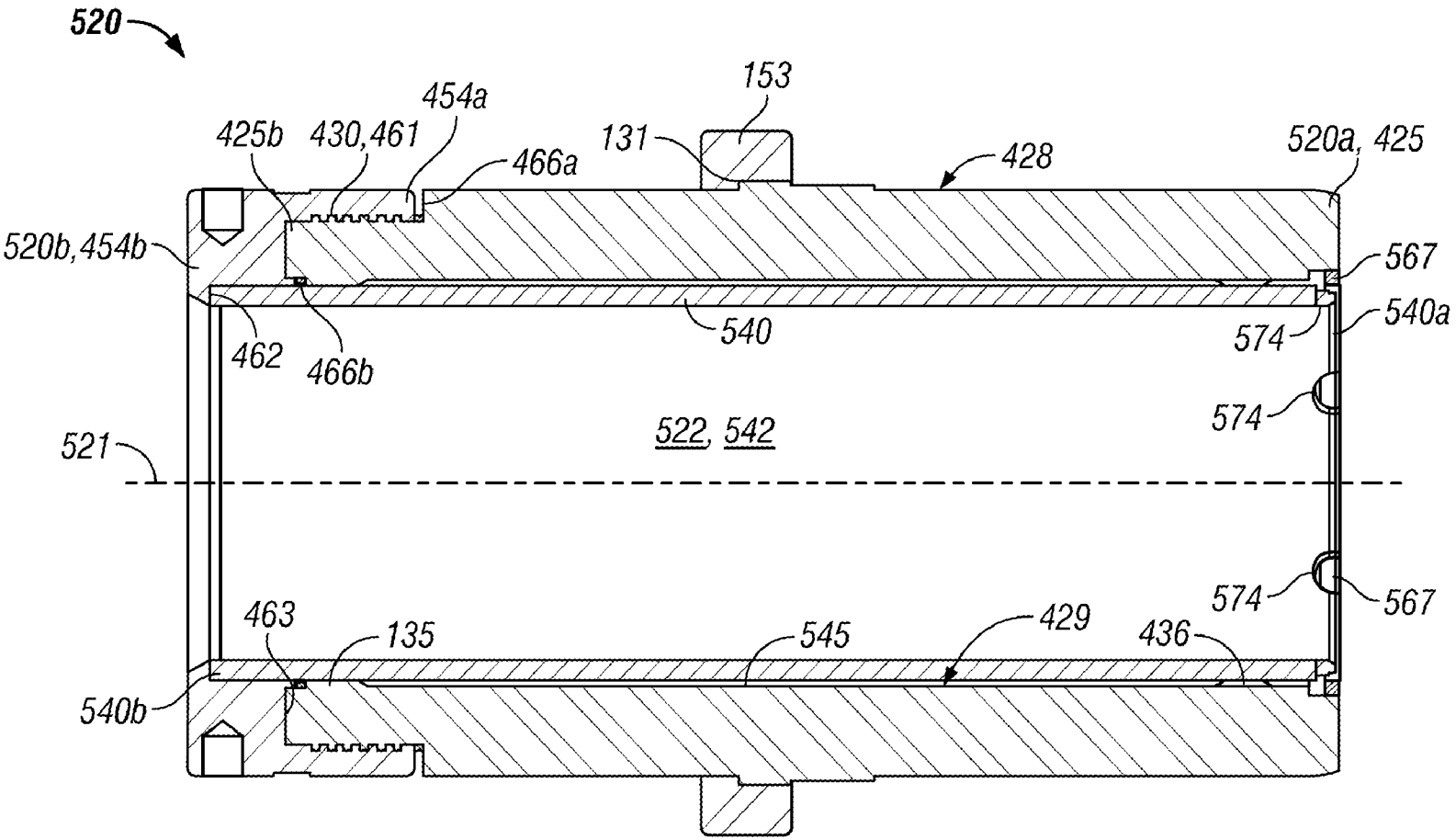
FIG. 11 is a cross-sectional view of an embodiment of a cylinder assembly in accordance with the principles described herein.

Referring now to FIG. 11, an alternative embodiment of a cylinder assembly 520 for use with a reciprocating pump (e.g., pump 10) is shown. For example, assembly 520 may be used in place of cylinder assembly 120 previously described. Assembly 520 is substantially the same in structure and function as cylinder assembly 420. Namely, cylinder assembly 520 has a central axis 521, ends 520*a, b*, and a through bore 522 extending between ends 520*a, b*. In addition, cylinder assembly 520 includes a cylindrical housing 425 as previously described, a cylindrical sleeve or liner 540 coaxially disposed within housing 425, and an end cap or sleeve retainer 454 as previously described. However, in this embodiment, no pressure balance insert (e.g., insert 470) is provided. Rather, in this embodiment, a plurality of circumferentially spaced cutouts 574 are provided in an end 540*a* of liner 540. Cutouts 574 extend radially through liner 540 and place a liner throughbore 542 in fluid communication with an annulus 545 radially positioned between housing 425 and liner 540 via flow passages between each pair of circumferentially adjacent lugs 436. In particular, each cutout 574 is circumferentially aligned with one flow passage 446 as previously described.

In this embodiment, an annular seal member 567 is radially disposed between housing 425 and liner 540 at liner end 540*a*. Seal member 567 does not completely extend over each entire cutout 574, thereby allowing fluid communication between a throughbore 542 in liner 540 and an annulus 545 radially positioned between housing 425 and liner 540. Further, two annular seal members 466*a, b* as previously described are disposed axially between retainer 454 and housing 425.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A fluid section for a reciprocating pump, comprising:

a cylinder assembly comprising:

a housing having a central axis, a first end, a second end opposite the first end, a throughbore extending axially between the first end and the second end, and a radially inner surface including a plurality of circumferentially spaced lugs proximal the first end of the housing;

a liner disposed within the throughbore of the housing, wherein the liner has a first end proximal the first end of the housing, a second end proximal the second end of the housing, a throughbore extending between the first end and the second end of the liner, and an outer cylindrical surface that slidingly engages the lugs;

an end cap coupled to the second end of the housing, wherein the end cap is adapted to retain the liner within the housing; and an annulus radially positioned between the liner and the housing, wherein the annulus is in fluid communication with the throughbore of the liner;

a piston slidingly disposed in the throughbore of the liner, wherein the piston is adapted to compress a fluid disposed in a pumping chamber within the liner, the pumping chamber extending axially through the throughbore of the liner between the piston and the first end of the housing.

2. The fluid section of claim 1, wherein the inner surface including an annular recess extending axially from proximal the first end of the housing to proximal the second end of the housing, and wherein the recess defines the annulus.

3. The fluid section of claim 2, wherein the inner surface of the housing further comprises an annular ridge proximal the second end of the housing; and wherein the annular recess extends axially from the ridge to the plurality of lugs.

4. The fluid section of claim 3, wherein each lug has a generally L-shaped cross-section including an axially extending base and a flange extending radially inward from the base, and wherein the outer cylindrical surface of the liner slidingly engages the base of each lug and axially abuts the flange of each lug.

5. The fluid section of claim 4, wherein the annular recess is disposed at a radius R1 relative to the central axis, the annular ridge has a radially inner surface disposed at a radius R2 relative to the central axis, the base of each lug has a radially inner surface disposed at a radius R3 relative to the central axis, and the flange of each lug has a radially inner surface disposed at a radius R4 relative to the central axis;

wherein the radius R1 is greater than the radius R2 and the radius R3;

wherein the radius R2 is the same as the radius R3; and wherein the radius R4 is less than the radius R3.

6. The fluid section of claim 5, wherein the liner has a cylindrical outer surface disposed at a radius R5 that is substantially the same as the radius R2.

7. The fluid section of claim 6, wherein the portion of the inner surface of the housing circumferentially disposed between each pair of circumferentially adjacent lugs is disposed the radius R1.

8. The fluid section of claim 6, further comprising a flow passage circumferentially disposed between each pair of circumferentially adjacent lugs and radially positioned between the liner and the housing, wherein each flow passage is in fluid communication with the annulus and the throughbore of the liner.

9. The fluid section of claim 1, wherein the end cap engages the second end of the liner.

10. The cylinder assembly of claim 9, further comprising a seal member disposed about the second end of the liner and axially positioned between the end cap and the second end of the housing.

11. The fluid section of claim 9, wherein the housing has a radially outer surface comprising external threads proximal the second end of the housing; and wherein the end cap has a radially inner surface comprising internal threads that threadingly engage the external threads of the housing.

12. A fluid section for a reciprocating pump, comprising:

a cylinder assembly comprising:

a housing having a central axis, a first end, a second end opposite the first end, and a throughbore extending axially between the first end and the second end;

a liner disposed within the throughbore of the housing, wherein the liner has a first end proximal the first end of the housing a second end proximal the second end of the housing, and a throughbore extending between the first end and the second end of the liner;

an end cap coupled to the second end of the housing, wherein the end cap is adapted to retain the liner within the housing; and an annulus radially positioned between the liner and the housing, wherein the annulus is in fluid communication with the throughbore of the liner;

a piston slidingly disposed in the throughbore of the liner, wherein the piston is adapted to compress a fluid disposed in a pumping chamber within the liner, the pumping chamber extending axially through the throughbore of the liner between the piston and the first end of the housing;

an annular insert coaxially disposed in the throughbore of the housing proximal the first end of the housing;

wherein the insert has a first end that engages the first end of the liner;

wherein the first end of the insert includes a plurality of circumferentially spaced cutouts, each cutout extending radially through the insert;

wherein each cutout is in fluid communication with the annulus and the throughbore of the liner.

13. The fluid section of claim 1, wherein the first end of the liner includes a plurality of circumferentially spaced cutouts, each cutout extending radially through the liner;

wherein each cutout is in fluid communication with the annulus and the throughbore of the liner.

14. A reciprocating pump, comprising:

a fluid section comprising:

a housing having a central axis, a first end, a second end opposite the first end, and a radially inner surface including a plurality of circumferentially spaced lugs proximal the first end of the housing;

a liner coaxially disposed within the housing, wherein the liner has a first end proximal the first end of the housing, a second end opposite the first end of the liner, a cylindrical throughbore extending between the first end and the second end of the liner, and an outer cylindrical surface that slidingly engages the lugs;

an end cap removably coupled to the second end of the housing, wherein the end cap axially abuts the second end of the liner; and an annulus radially positioned between the liner and the housing, wherein the annulus is in fluid communication with the throughbore of the liner;

a piston slidingly disposed in the throughbore of the liner;

a power section connected to the piston with an extension rod, wherein the power section is adapted to axially reciprocate the piston within the liner.

15. The reciprocating pump of claim 14, wherein the inner surface of the housing includes an annular ridge axially spaced apart from the lugs; and wherein the annulus extends axially from the ridge to the circumferentially spaced lugs.

16. The reciprocating pump of claim 15, further comprising a plurality of flow passages in fluid communication with the throughbore of the liner and the annulus, wherein each flow passage is disposed between a pair of circumferentially adjacent lugs.

17. The reciprocating pump of claim 15, wherein each lug has a generally L-shaped cross-section including an axially extending base and a flange extending radially inward from the base;

wherein the outer cylindrical surface of the liner slidingly engages the ridge and the base of each lug; and wherein the first end of the liner engages the flange of each lug.

18. The reciprocating pump of claim 16, wherein the first end of the liner includes a plurality of circumferentially spaced cutouts, each cutout extending radially through the liner;

wherein each cutout is in fluid communication with one or more of the flow passages.

19. A method for loading a liner of a fluid section of a reciprocating pump, comprising:

(a) disposing a cylindrical liner within a housing, wherein the liner has a central axis, a first end, a second end opposite the first end, a throughbore extending axially from the first end to the second end, and an outer cylindrical surface that slidingly engages a plurality of circumferentially spaced lugs proximal the first end disposed on an radially inner surface of the housing;

(b) moving a piston axially through the throughbore of the liner;

(c) compressing a fluid in the throughbore with the piston;

(d) flowing a portion of the fluid from the throughbore to an annulus radially positioned between the liner and the housing during (b);

(e) applying radially compressive forces on the liner with the fluid in the annulus during (c).

20. The method of claim 19, wherein the portion of the fluid in the annulus has a pressure P1, and the fluid in the throughbore has a pressure P2 that is substantially the same as the pressure P1.

21. The method of claim 19, wherein the inner surface of the housing comprises a shoulder proximal the second end of the liner;

wherein the annulus extends axially between the shoulder and the lugs; and wherein (d) comprises flowing the portion of the fluid from the throughbore of the liner through a plurality of flow passages disposed between each pair of circumferentially adjacent lugs into the annulus.

* * * * *